United States Patent [19]

Fukami et al.

[11] Patent Number: 4,460,388

[45] Date of Patent: Jul. 17, 1984

[54] TOTAL HEAT EXCHANGER

[75] Inventors: Akira Fukami; Kunio Okamoto, both of Okazaki, Japan

[73] Assignee: Nippon Soken, Inc., Nishio, Japan

[21] Appl. No.: 398,278

[22] Filed: Jul. 14, 1982

[30] Foreign Application Priority Data

Jul. 17, 1981 [JP] Japan ..... 56-106679[U]
Aug. 4, 1981 [JP] Japan ..... 56-121328

[51] Int. Cl.[3] ..... B01D 51/00; B01D 53/04

[52] U.S. Cl. ..... 55/269; 55/387; 55/521; 55/524; 165/166; 428/185

[58] Field of Search ..... 55/269, 316, 387–389, 55/486, 487, 497, 521, 524, 527, 528, 278; 252/422, 447, 477 R; 165/166; 428/183–185

[56] References Cited

U.S. PATENT DOCUMENTS

| | | | |
|---|---|---|---|
| 3,265,129 | 8/1966 | Bawabe | 165/166 |
| 3,982,981 | 9/1976 | Takao et al. | 165/166 |
| 4,289,513 | 9/1981 | Browhill et al. | 55/527 |

FOREIGN PATENT DOCUMENTS

| | | | |
|---|---|---|---|
| 145527 | 3/1950 | Australia | 165/166 |
| 2400734 | 7/1975 | Fed. Rep. of Germany | 165/166 |
| 47-19990 | 6/1972 | Japan . | |
| 51-38464 | 10/1976 | Japan . | |
| 54-44255 | 4/1979 | Japan | 55/387 |
| 55-121394 | 9/1980 | Japan . | |
| 55-160297 | 12/1980 | Japan . | |
| 818603 | 8/1959 | United Kingdom | 165/166 |

OTHER PUBLICATIONS

C. M. Berger et al., Cross Flow Heat Exchanger, IBM Technical Disclosure Bulletin, vol. 13, No. 10, Mar. 1971.

*Primary Examiner*—David L. Lacey
*Attorney, Agent, or Firm*—Cushman, Darby & Cushman

[57] ABSTRACT

A heat exchanger comprises an elongated plate folded in corrugated fashion and defining a stack of a number of laminated air passages defined by spacer parallel plane heat transfer faces or plates connected alternately along opposite side edges by narrow partition plates. In alternate air passages, spacer plates are disposed having such a wavy or corrugated configuration as to conduct a first current of air flowing into such alternate passages from one open end thereof to flow out from an open side portion thereof opposite the corresponding partition plate. In the remainder of the air passages are disposed spacer plates having such a wavy or corrugated configuration as to conduct a second current of air flowing into such passages from the open ends thereof, opposite those into which the first air current flows, to flow out from open side portions thereof opposite those out from which the first current flows.

4 Claims, 15 Drawing Figures

3a
3a-1
3a-2
2B-6
E
V
2B
2B-1
D
4a-1
4a
4a-3
4a-2
2B-7
G
F
θ
2c
2C
4b-2
B
2B-5
4b
4b-3
4b-1
U
3b
2B-2
2B-4
3b-2
3b-1
2B-3

Fig. 14
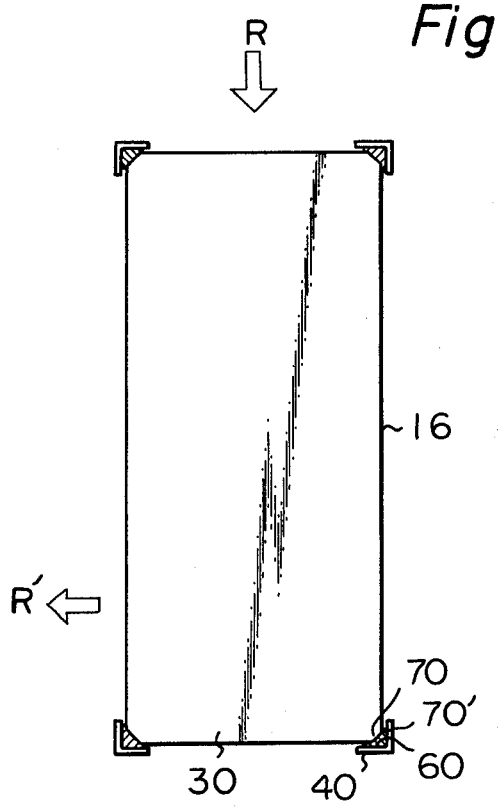
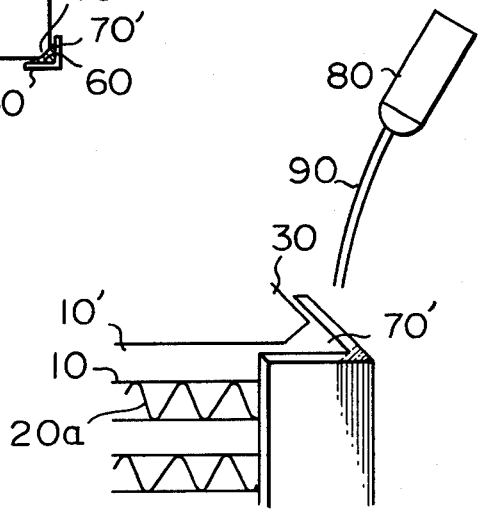
Fig. 15

TOTAL HEAT EXCHANGER

BACKGROUND OF THE INVENTION (1) Field of the Invention

The present invention relates to a heat exchanger in which heat exchange is effected between two air currents differing in temperature and humidity. More particularly, the present invention relates to an apparatus used for ventilation of, for example, an air-conditioned room of a house or car, in which heat exchange is carried out between apparent heat and latent heat possessed by air outside the room and possessed by air inside the room, and the temperature degree and humidity rate of the introduced air is brought to a level near that of the discharged air to effect ventilation and recovery of heat.

(2) Description of the Prior Art

As a known heat exchanger of this type (hereinafter referred to as "total heat exchanger"), the apparatus disclosed in Japanese Patent Publication No. 47-19990 can be mentioned. This known apparatus comprises a plurality of laminated plane partition plates composed of a heat-conductive, moisture-permeable material and a plurality of spacer plates having a saw tooth-like wavy or corrugated section, which are arranged between every two adjacent partition plates, the forming directions of the wavy configuration of the spacer plates being alternately arranged at 90°. Primary and secondary air currents to be heat-exchanged are allowed to flow through a plurality of air passages defined by the wavy configurations of the spacer plates.

In this known total heat exchanger, because of the above-mentioned structure, the primary air current inevitably flows at substantially 90° to the secondary air current. As is well-known, the heat exchange efficiency of a cross flow heat exchanger is lower than that of a counter flow heat exchanger, and in order to obtain a high heat exchange efficiency in the cross flow heat exchanger, it is necessary to increase the size of the heat exchanger. As a means for overcoming this disadvantage, there have been proposed apparatuses as disclosed in Japanese Patent Publication No. 51-38464 and Japanese Patent Application Laid-Open Specifications Nos. 55-121394 and 55-160297. In each of these apparatuses, flow passages of the substantial counter flow type are laid out so as to obtain a high heat exchange efficiency without increase in size. However, many difficulties are involved in the construction of these apparatuses and the manufacturing costs are inevitably increased.

In the conventional total heat exchanger of the abovementioned type, plane partition plates and wavy spacer plates are alternately laminated and posts having an L-shaped section are arranged at four corners of the so-constructed heat exchanger proper. The heat exchanger proper is secured by fixing plane plates to the upper and lower ends of the posts and blocking or filling spaces between both the side edges of the posts and the laminated faces of the total heat exchanger proper with an adhesive.

If there are spaces between the posts and the laminated faces of the total heat exchanger proper, some air to be removed from inside the room to outside the room is returned into the room and the ventilation efficiency is reduced. In order to prevent this reduction of the ventilation efficiency, the spaces between the posts and the laminated faces of the total heat exchanger proper are blocked or filled with an adhesive.

However, in the conventional apparatus, since the adhesive is filled between both the side edges of the posts and the laminated faces of the total heat exchanger proper, the adhesive protrudes along a certain width of the laminated faces of the total heat exchange proper. Accordingly, spaces through which the air current does not flow are formed in the rear of the protrusion of the adhesive on the laminated faces, and heat exchange is not performed in these spaces. Therefore, the heat transfer area of the total heat exchanger is decreased by the area of these spaces. Since this decrease of the heat transfer area is caused in both the longitudinal and lateral directions and the decreased area corresponds to about 10% of the total heat transfer area, the heat exchange efficiency is considerably reduced.

SUMMARY OF THE INVENTION

The present invention is to solve the above-mentioned problems of the conventional apparatuses.

It is therefore a primary object of the present invention to provide a total heat exchanger of the counter flow type which is small in size, cheap, and has a high heat exchange efficiency.

Another object of the present invention is to provide a total heat exchanger in which the overall heat exchange efficiency is increased by preventing a decrease in the heat transfer area by an adhesive filled in the area between the total heat exchanger proper and the posts.

In accordance with the present invention, a total heat exchanger is provided comprising plane partition plates having a heat conductivity and a moisture permeability and spacer plates having a wavy section, which are alternately laminated, a number of small passages defined by the wavy configuration of the spacer plates being used to conduct air. The exchanger is formed by folding one thin plate to provide a stack of a number of spaced parallel heat transfer faces or plates alternately connected along opposite end edges by narrow partition faces or plates. This construction provides a number of laminated air passages defined between each pair of adjacent heat transfer plates and the corresponding partition plate connecting the same. In alternate of such air passages, there is disposed a spacer plate having such a wavy or corrugated configuration so as to conduct a first current of air flowing in from one open end of the corresponding air passage to flow out from an open side portion of that air passage opposite the partition plate. Spacer plates are disposed in the remaining air passages each having such a wavy or corrugated configuration so as to conduct a second air current flowing, countercurrent to the first air current, into such remaining passages from the open ends thereof opposite those into which the first air current flows, and to flow out from open side portions of such passages opposite those from which the first current flows.

According to the present invention, a total heat exchanger of the counter flow type can be constructed very easily by adopting the above structure, this heat exchanger being cheap with a high heat exchange efficiency and even being of small size.

In the total heat exchanger of the present invention having the above-mentioned structure, if four corner portions of the total heat exchanger proper are omitted or cut out and an adhesive is filled in spaces defined by the cut-out portions and the inner sides of L-shaped posts to secure the total heat exchanger proper, reduction of the heat transfer area of the total heat exchanger due to protrusion of the adhesive on the outside of the posts is prevented and the overall heat transfer efficiency of the total heat exchanger is improved. Accordingly, the total heat exchanger of the present invention is quite advantageous.

Other objects and features of the present invention will become more apparent in the following detailed description made with reference to the preferred embodiments illustrated in the accompanying drawings.

BRIEF DESCRIPTION OF THE DRAWINGS

FIG. 6 showing a heat transfer face on the side of the primary air current seen in the direction normal to the heat transfer face; FIG. 7 being a side view of the heat transfer face shown in FIG. 5; and FIG. 8 being a side view of the heat transfer face shown in FIG. 6;

FIG. 14 is a cross-sectional view showing one example of the arrangement of posts in the total heat exchanger according to the present invention;

FIG. 15 is a diagram illustrating one method for filling an adhesive in the space portion showing in FIG. 14.

DETAILED DESCRIPTION OF THE PREFERRED EMBODIMENTS

The known total heat exchanger will first be described so as to clarify the differences of the preferred embodiments of the present invention over the conventional technique.

Figure 1:
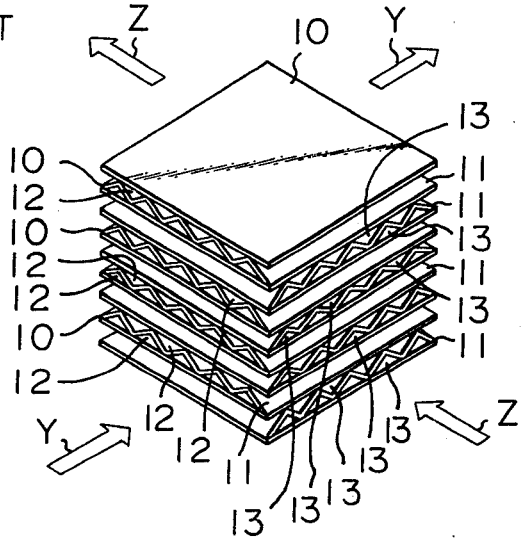
Fig. 1 PRIOR ART
FIG. 1 is a perspective view showing the structure of the conventional total heat exchanger.

The above-mentioned total heat exchanger disclosed in Japanese Patent Publication No. 47-19990 is illustrated in FIG. 1. This total heat exchanger comprises a plurality of plane partition plates 10 composed of a heat-conductive, moisture-permeable material and a plurality of spacer plates 11 having a saw tooth-like wavy or corrugated section, which are arranged between every two adjacent partition plates 10, the forming direction of the wavy configuration of the spacer plates 11 being alternately changed by 90°. A plurality of primary air holes or passages 12 for leading air in the direction indicated by arrow Y and a plurality of air holes or passages 13 for leading air in the direction indicated by arrow Z are formed between the wavy faces of the spacer plates 11 and the partition plates 10.

In this known total heat exchanger, because of the above-mentioned structure, the primary air current (indicated by arrow Y) inevitably intersects the secondary air current (indicated by arrow Z) at substantially 90°. As is well-known, the heat exchange efficiency of a cross flow heat exchanger is lower than that of a counter flow heat exchanger, and in order to obtain a high heat exchange efficiency in the cross flow heat exchanger, it is necessary to increase the size of the heat exchanger. This is a great defect of the known total heat exchanger.

The structure of the total heat exchanger of the present invention will now be described in contrast to the above-mentioned known total heat exchanger.

Figure 2:
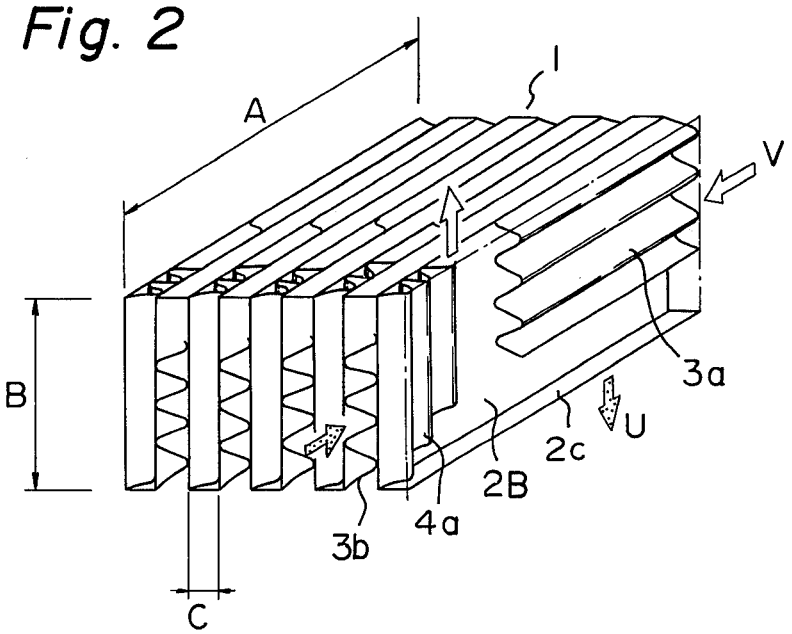
FIG. 2 is a perspective view diagrammatically illustrating the structure of one embodiment of the total heat exchanger according to the present invention.
Figure 3:
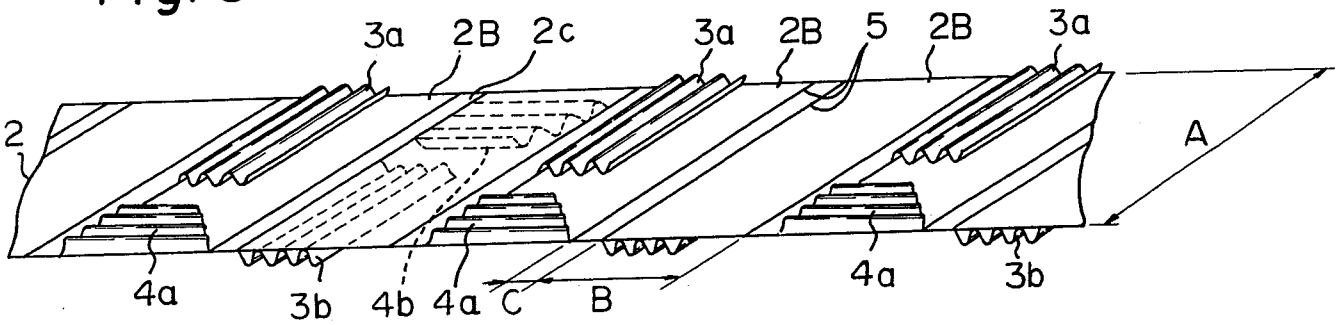
FIG. 3 is a developed perspective view showing the total heat exchanger shown in FIG. 2.
Figure 4:
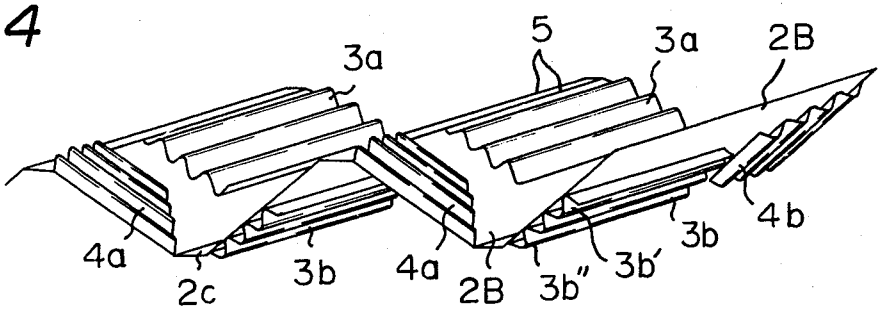
FIG. 4 is a perspective view showing midway into the production of the total heat exchanger shown in FIG. 2.

FIG. 2 illustrates the entire structure of one embodiment of the total heat exchanger according to the present invention. In this total heat exchanger 1, one thin plate 2 having a heat conductivity and a moisture permeability is in a corrugated fashion folded along creases 5 to form a plurality of spaced parallel plane heat transfer faces or plates 2B and a plurality of connecting narrow edge partition faces or plates 2C, as shown in FIG. 3. The spaces defined by the heat transfer faces 2B and partition faces 2C are used as passages through which the primary air current and secondary air current pass alternately. Supposing that the width of one plate 2 is A, the width B of the heat transfer face 2B is adjusted to be from about ¼ to ½ of A and the width C of the partition face 2C is much smaller than A and B and is equal to the height of spacer plates **3*a*, 3*b*, 4*a*, and 4*b* connected onto the heat transfer faces 2B. The width C is ordinarily about 1 to 3 mm. The spacer plates 3*a*, 3*b*, 4*a* and 4*b* are arranged to maintain a certain space between every two adjacent heat transfer faces 2B of the plate 2, and these spacer plates are formed to have a wavy or corrugated configuration. These spacer plates are divided into two types differing in shape and size. Namely, the spacer plates 3*a* and 3*b* are the same in the shape and size, and the spacer plates 4*a* and 4*b* are the same in shape and size. The spacer plates 3*a* and 4*a* and the spacer plates 3*b* and 4*b*, differing in shape and size are arranged in sets or pairs, and these sets or pairs of spacer plates are alternately connected to the heat transfer faces 2B of the plate 2 on opposite sides of each other. More specifically, in FIG. 3, the spacer plates 3*a* and 4*a* are alternately connected on the upper side and the spacer plates 3*b* and 4*b* are alternately connected on the lower side. This connection can easily be accomplished by using a paste or hot-melt adhesive. By folding the plate 2 in a corrugated fashion along the creases 5 as shown in FIG. 4, a total heat exchanger having a three-dimensional structure as shown in FIG. 2 can be obtained. In this case, it is preferred that an adhesive be applied to the points (crests of waves) opposite to the bonding points of the spacer plates 3*a*, 3*b*, 4*a*, and 4*b* and the plate 2 be then folded to effect the connection, because the spacer plates 3*a*, 3*b*, 4*a* and 4*b* are connected to the two adjacent heat transfer faces 2B**, and hence, the bonding strength of the total heat exchanger as a whole is increased.

Figures 5, 6, 7, 8:
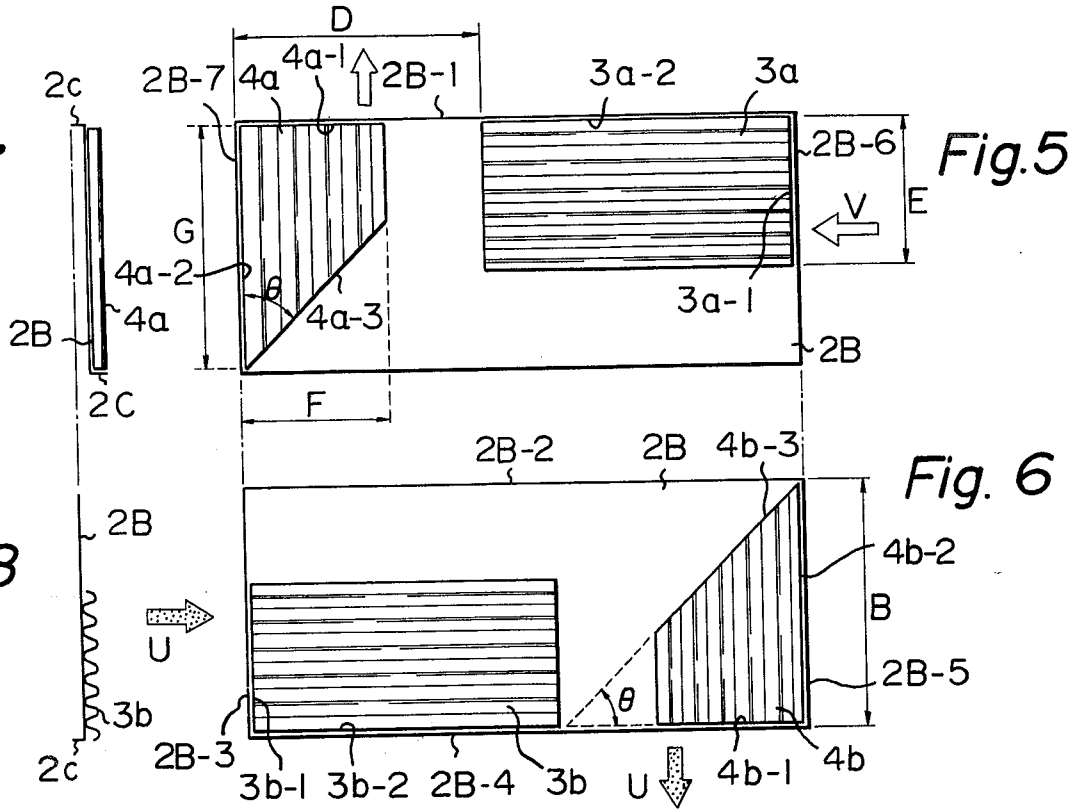
FIGS. 5 through 8 illustrate two adjacent heat transfer faces in the total heat exchanger shown in FIG. 2, FIG. 5 showing a heat transfer face on the side of the secondary air current seen in the direction normal to the heat transfer face.

The bonding points, shapes and sizes of the spacer plates **3*a*, 3*b*, 4*a*, and 4*b* will now be described. FIGS. 5 and 6 show the total heat exchanger 1 of FIG. 2, seen in the direction normal to the heat transfer face 2B** of the partition plate. For convenience of the illustration, two heat transfer faces 2B are separated in FIGS. 5 and 6. FIGS. 7 and 8 are side views corresponding to FIGS. 5 and 6, respectively. Actually, the side edge 2B-1 of the heat transfer face 2B shown in FIG. 5 and the side edge 2B-2 of the heat transfer face 2B shown in FIG. 6 are connected to each other through the partition face 2C, as shown in FIGS. 7 and 8. The spacer plates 3*a* and 3*b* are connected to the current inlet side, and they have wavy configurations as shown in FIGS. 6 and 8. The air currents flow along the wavy configurations as indicated by arrows in the drawings. One edge 3*b*-1 (hereinafter referred to as "end edge portion") normal to the wavy configuration of the spacer plate 3*b* is made in substantial alignment with the end edge 2B-3 of the heat transfer edge 2B and one edge 3*b*-2 (hereinafter referred to as "side edge portion") parallel to the wavy configuration is made in substantial alignment with the side edge 2B-4 of the heat transfer face 2B. The spacer plate 3*a* is similarly connected to the heat transfer face 2B at the position of a point of symmetry with the spacer plate 3*b*. More specifically, as shown in FIG. 5, one end edge portion 3*a*-1 of the spacer plate 3*a* is made in substantial alignment with one end edge 2B-6 of the heat transfer face 2B and one side face portion 3*a*-2 is made in substantial alignment with one side edge 2B-1 of the heat transfer face 2B. The spacer plates 3*a* and 3*b* have a rectangular shape, and the length of the side edge is adjusted so that the difference D between the length of the side edge and the width A of the partition plate 2 is substantially equal to the width B of the heat transfer face 2B. The reason is that since the portion indicated by the reference symbol D in FIG. 5 acts as the outlet of the air current, in order to reduce the pressure loss of the current, it is preferred that the sectional area of the current passage be substantially constant in all the flow passages. Furthermore, it is preferred that the length E of the end edge portion be about $\frac{1}{3}$ to about $\frac{3}{4}$ of the width B of the heat transfer face 2B. The reason will be described hereinafter.

The spacer plates 4*a* and 4*b* are connected on the air current outlet side, and they have configurations as shown in FIGS. 5 and 6. Accordingly, air currents flow along the wavy configurations as indicated by arrows in the drawings. One end edge portion 4*b*-1 of the spacer plate 4*b* is made in substantial aignment with one side edge 2B-4 of the heat transfer face 2B, and one side edge portion 4*b*-2 is made in substantial alignment with one end edge 2B-5 of the heat transfer face 2B. The inclination angle $\theta$ of the other end edge portion 4*b*-3 is adjusted to about 45°. The spacer plate 4*a* is similarly connected to the heat transfer face 2B at the position of a point of symmetry with the spacer plate 4*b*. More specifically, as shown in FIG. 5, one end edge portion 4*a*-1 of the spacer plate 4*a* is made in substantial alignment with one side edge 2B-1 of the heat transfer face 2B, and one side edge portion 4*a*-2 is made in substantial alignment with one end edge 2B-7 of the heat transfer face 2B. The inclination angle $\theta$ of the other end edge portion 4*a*-3 is adjusted to about 45°. Each of the spacer plates 4*a* and 4*b* has a trapezoidal shape in which the length G of the side edge portions 4*a*-2 and 4*b*-2 is substantially equal to the width B of the heat transfer face 2B and the length (height) F of the end edge portions 4*a*-1 and 4*b*-1 is about $\frac{1}{2}$ to 1/1 of the above-mentioned length D (see the broken line in FIG. 5).

If the spacer plates 3*a*, 3*b*, 4*a*, and 4*b* are arranged on the heat transfer face 2B in the above-mentioned manner, air flows in the form of counter currents as indicated by arrows U and V in FIGS. 2, 5, and 6. Incidentally, the arrow U shows the primary air current and the arrow V shows the secondary air current. It is because of the presence of the partition face 2C that the primary air current U does not leak to the outside from the side edge 2B-2 of the heat transfer face 2B. Thus, it is seen that the partition face 2C is very valuable. Leakage of the secondary air current V is similarly prevented. The partition faces 2C are formed only by folding one partition plate 2 corrugated along the creases 5. With reference to the sizes of the spacer plates 3*a*, 3*b*, 4*a*, and 4*b*, the length E of the end edge portion of each of the spacer plates 3*a* and 3*b* is adjusted to about $\frac{1}{3}$ to $\frac{3}{4}$ of the width B of the heat transfer edge 2B, and the length F of the end face portion of each of the spacer plates 4*a* and 4*b* is adjusted to about $\frac{1}{2}$ to 1/1 of the difference D between the width A of the partition plate 2 and the length of the side face portions of the spacer plates 3*a* and 3*b*. The reasons will now be described.

Figure 9:
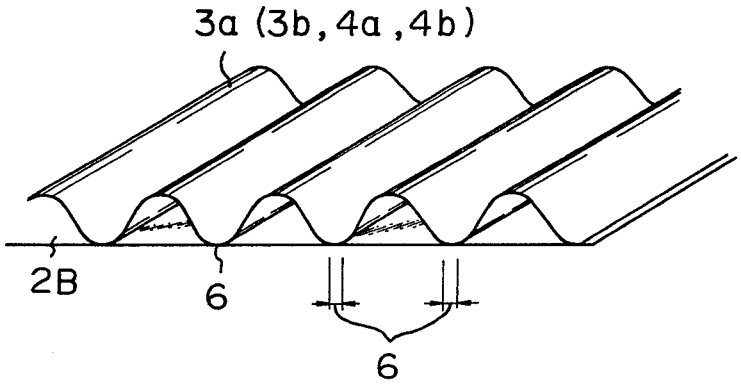
FIG. 9 is an enlarged perspective view showing the connection area between the heat transfer face and the spacer plate in the total heat exchanger shown in FIG. 2.

Joint portions of the spacer plates 3*a*, 3*b*, 4*a*, and 4*b* to the heat transfer face 2B of the partition plate are shown in FIG. 9. For structural reasons, the joint portion 6 of the spacer plate 3*a* to the heat transfer face 2B should naturally have a double structure, and therefore, in this joint portion 6, the primary current is doubly partitioned from the secondary air current by the partition plate 2 and the spacer plate 3*a*. Accordingly, a good transfer of heat or permeation of moisture is not effected in the joint portion 6. In other words, this joint portion 6 reduces the effective heat transfer area of the heat transfer face 2B. Accordingly, if the sizes of the spacer plates 3*a*, 3*b*, 4*a*, and 4*b* are reduced to decrease the area of the joint portion 6, the effective heat transfer area can be increased and the heat transfer efficiency can be improved. However, from the results of experiments made by us, it has been confirmed that if the sizes of the spacer plates 3*a*, 3*b*, 4*a*, and 4*b* are excessively reduced, a disadvantage described below arises. The heat transfer face not connected to the spacer plate elongates or contracts according to the temperature or humidity of the air current, and therefore, this heat transfer face involves the risk of such deformation hindering the flow of the air current. It has also been found that this undesirable deformation is due to the curling phenomenon of the paper material. If there is such hindrance due to deformation of the heat transfer face, the air current flows to avoid this hindrance, with the result that the symmetry and uniformity between the primary and secondary air currents are degraded and the heat exchange efficiency is drastically reduced. Thus, if the sizes of the spacer plates are too large, the effective heat transfer area is reduced because of the presence of the joint portion 6, and if the sizes of the spacer plates are too small, the heat transfer face 2B is deformed to hinder the flow of the air current, resulting in reduction of the heat exchange efficiency. Accordingly, it is obvious that there are optimal values for the sizes of the spacer plates. From the results of experiments made by us, it has been found that best results can be obtained when the above values E and F are controlled within the above-mentioned ranges.

Figure 10:
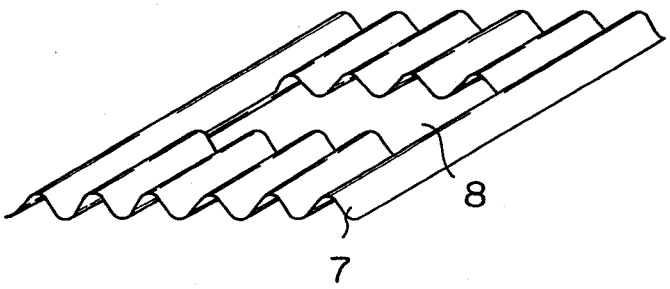
FIG. 10 is an enlarged perspective view showing the structure of the spacer plate in another embodiment of the present invention.

If a window or open portion 8 in spacer plate 7 in FIG. 10 is used, the effective heat transfer area is further increased and good results are obtained. Furthermore, the air current which has passed through the wavy portion is disturbed by this window 8 to form a turbulent flow. Accordingly, a good heat conduction state is produced and attainment of a special effect in addition to the effect of increasing the effective heat transfer area can be expected.

From the results of experiments made by us, it has been found if the spacer plates 3*a*, 3*b*, 4*a*, and 4*b* are collectively taken into consideration, it is most preferred that the total area of the spacer plates be about $\frac{1}{3}$ to $\frac{2}{3}$ of the heat transfer face 2B of the partition plate 2.

When the partition plate and spacer plates are made from a paper material containing active carbon fibers excellent in the heat conductivity and moisture permeability, for example, a paper material prepared from active carbon fibers and adhesive fibers such as polyvinyl alcohol fibers or cellulose fibers, the efficiency of exchange of heat or moisture is remarkably improved.

The arrangement of posts attached to the total heat exchanger proper will now be described.

In order to clarify the characteristic features of this arrangement in the present invention, the conventional post arrangement will first be described.

Figure 11:
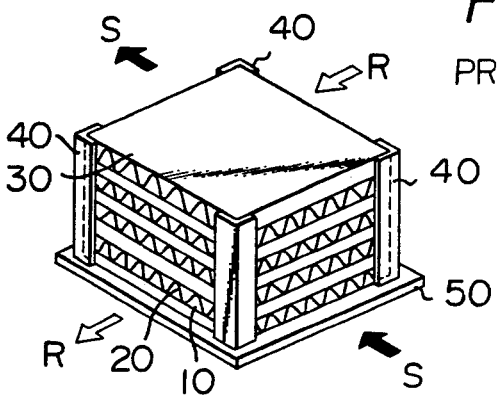
Fig. 11 PRIOR ART
FIGS. 11 and 12 are perspective and cross-sectional views, respectively showing the structure of posts arranged in the conventional total heat exchanger proper.
Figure 12:
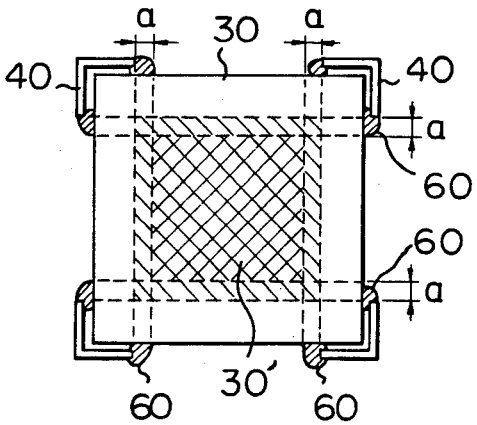
Fig. 12 PRIOR ART

FIGS. 11 and 12 illustrate the conventional arrangement of posts attached to the total heat exchanger proper. In the conventional total heat exchanger, plane partition plates 10 and wavy spacer plates 20 are alternately laminated so that the wave directions of the spacer plates alternately intersect one another at right angles, whereby a total heat exchanger proper 30 is constructed. Posts 40 having an L-shaped section are arranged at four corners of the total heat exchanger proper 30, and the total heat exchanger proper 30 is secured by fixing plane plates 50 to the upper and lower ends of the posts 40 and blocking spaces between both the side edges of the posts 40 and the laminated faces of the total heat exchanger proper 30 with an adhesive 60 as shown in FIG. 12.

In the conventional total heat exchanger having the above-mentioned structure, air in the room is discharged to the outside in the direction of arrow R through wavy configurations of the spacer plates 20, while outside air is introduced into the room in the direction of arrow S through wavy configurations of the spacer plates 20, and heat exchange is effected between outside air and inside air through the partition plates 10.

Figure 13:
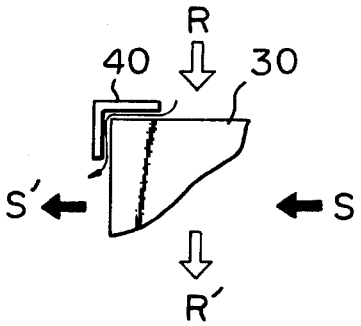
FIG. 13 is a diagram of posts which is given to illustrate the present invention.

If there are spaces between the posts 40 and the laminated faces of the total exchanger proper 30 as shown in FIG. 13, a part of air to be removed from the room to outside the room is returned into the room as indicated by the small unlettered arrow and the ventilation efficiency is reduced. In order to prevent this reduction of the ventilation efficiency, the spaces between the posts 40 and the laminated faces of the total heat exchanger proper 30 are blocked with an adhesive, as described above.

However, in the conventional total heat exchanger, since the adhesive 60 is filled between both the side edges of the posts 40 and the laminated faces of the total heat exchanger proper 30 as shown in FIG. 12, the adhesive 60 protrudes along a certain width a on the laminated faces of the total heat exchanger proper 30. Accordingly, in the hatched portion in FIG. 12, heat exchange is not conducted, and therefore, the heat transfer area 30' of the total heat exchanger is decreased by the area of this portion. Since this decrease of the heat transfer area is caused in both the longitudinal and lateral directions and the decreased area corresponds to about 10% of the total heat transfer area, the heat exchange efficiency is considerably reduced.

A preferred embodiment of the present invention capable of solving this problem involved in the conventional technique is illustrated in FIGS. 14 and 15. FIG. 14 is a cross-sectional view of this embodiment. Four corners of the total heat exchanger proper are removed or cut out to form cut-out portions 70, and an adhesive 60 is filled in spaces 70' formed between the cut-out portions 70 and the inner sides of posts 40 and the adhesive 60 does not protrude beyond both the side edges of the posts 40. Filling of the adhesive 60 in the spaces 70' is accomplished, for example, according to the following procedures.

After four L-shaped posts 40 and a lower plate (not shown) are assembled to the total heat exchanger proper 30, a long tube 90 is attached to a vessel 80 containing the adhesive as shown in FIG. 15, and the open end of this tube is inserted into the bottom of the space 70' and the tube 90 is drawn up while the adhesive is discharged. Thus, the adhesive is filled only in the space 70' and the post 40 can be bonded to the total heat exchanger proper 30 in good condition. Since the adhesive does not protrude into the air entry and exit faces (laminated faces) of the total heat exchanger proper 30 beyond the side edges of the posts, the heat transfer area of the total heat exchanger does not decrease at all.

The shape of the cut-out portion 70 of the total heat exchanger proper is not limited to one shown in the drawings. It may have a concave shape or any other shape.

We claim:

1. A total heat exchanger comprising:

a stack of plane parallel spaced heat-exchange plates, of material having heat conductivity and moisture permeability, integrally connected alternately along the entire length of their opposite side edges by narrow plane partition platess of the same material to define alternate passages having inlet ends and open side portions, for first and second counter-currents of air, respectively, flowing into the inlet ends of said passages from opposite sides of said exchanger, all of said plates being defined by a folded single strip of said material;

first sets of corrugated spacer plates disposed in alternate of said passages so as to conduct a portion of the first air current flowing into each of said alternate passages, from the corresponding inlet end thereof, to flow out of said open side portions of said alternate passages opposite the corresponding partition plate thereof; and second sets of corrugated spacer plates disposed in the remaining of said passages so as to conduct a portion of the second air current flowing into each of said remaining passages, from the corresponding inlet end thereof opposite said inlet ends of said alternate passages, to flow out of said open side portions of said remaining passages opposite the corresponding partition plate thereof;

said first and second sets of spacer plates each comprising at least two separate spacer plates arranged at a position of a point of symmetry with respect to the at least two separate corrugated spacer plates of adjacent passages.

2. The heat exchanger defined in claim 1 wherein:

one of the plates of each set is substantially rectangular, arranged at the inlet end of the corresponding passage, spaced from the corresponding partition plate, the corrugations thereof extend normal to the inlet end of said passage, the width of said one plate being from $\frac{1}{3}$ to $\frac{1}{4}$ of the width of said passage and the length of said one plate being such that the difference between the length of said one plate and the length of said heat exchange plates is substantially equal to the width of said heat exchange plates; and the other of said plates of each set is spaced from said one plate, has corrugations extending normal to those of said one plate, is arranged adjacent to and close to the end of the corresponding passage opposite the inlet end thereof, has the end thereof opposed to the corresponding partition plate inclined thereto at an angle of about 45°, and has a width of the order of $\frac{1}{2}$ to 1 of the difference between the length of said one plate and the width of said passage.

3. The heat exchanger defined in claims 1 or 2 wherein at least one plate of each set has a non-corrugated open portion therein in order to increase the effective heat transfer area of the exchanger and effect turbulent flow of the air currents.

4. The heat exchanger defined in claim 1 including four posts of angle-section opposed to and enclosing the corresponding corners of the stack extending normal to the heat exchanger plates, said four corners being cut off to define spaces between the stack and the posts; and adhesive material filling said spaces to secure said stack to said posts without protrusion of said adhesive material beyond the side edges of said posts.

* * * * *